US005256328A

United States Patent [19]

Cavanagh et al.

[11] Patent Number: 5,256,328

[45] Date of Patent: Oct. 26, 1993

[54] LIQUID TOILET BOWL CLEANER AND SANITIZER CONTAINING HALOGEN DONATING NANOPARTICLES

[75] Inventors: James W. Cavanagh, Ramsey, N.J.; Robert P. Manzo, Chester, N.Y.

[73] Assignee: Eastman Kodak Company, Rochester, N.Y.

[21] Appl. No.: 991,449

[22] Filed: Dec. 16, 1992

[51] Int. Cl.[5] ..... C11D 3/395; C11D 3/48; C11D 7/54; C11D 17/08

[52] U.S. Cl. ..... 252/102; 134/2; 252/91; 252/95; 252/103; 252/104; 252/173; 252/174.13; 252/186.34; 252/186.36; 252/187.1; 252/187.33; 252/187.34; 252/311; 252/313.1; 252/DIG. 14; 422/37

[58] Field of Search ..... 252/95, 102, 103, 104, 252/186.34, 186.36, 187.1, 187.33, 187.34, 173, DIG. 14, 174.13, 91, 311, 313.1; 134/2; 422/37

[56] References Cited

U.S. PATENT DOCUMENTS

| | | | |
|---|---|---|---|
| 3,689,421 | 9/1972 | Briggs | 252/95 |
| 3,767,586 | 10/1973 | Rutkiewic | 252/187.33 |
| 3,868,336 | 2/1975 | Mazzola | 252/527 |
| 3,897,357 | 7/1975 | Carmello | 252/106 |
| 3,970,576 | 7/1976 | Carmello | 252/106 |
| 4,011,172 | 3/1977 | Marsan | 252/187.34 |
| 4,800,036 | 1/1989 | Rose | 252/102 |
| 4,839,077 | 6/1989 | Cramer | 252/98 |
| 4,913,828 | 4/1990 | Caswell | 252/8.8 |
| 5,145,684 | 9/1992 | Liversidge | 424/489 |

*Primary Examiner*—Dennis Albrecht
*Attorney, Agent, or Firm*—Dressler Goldsmith Shore Sutker & Milnamow, Ltd.

[57] ABSTRACT

The present invention is directed to a liquid toilet bowl cleaning and sanitizing composition comprising an aqueous dispersion of particles of at least one halogen donating compound wherein said particles have a surface modifier absorbed on the surface thereof in an amount sufficient nanometers (nm). The compositions of the present invention can contain other conventional ingredients in toilet bowl cleaning compositions such as enzymes, surfactants, perfumes, dyes and other similar ingredients. In a preferred embodiment the composition contains:

0.2–10.0 Weight percent surfactant;
35.0–75.0 Weight percent halogen donating nanoparticles;
1.0–7.0 Weight percent dye;
0–3.0 Weight percent alkali;
0.05–0.5 Weight percent fragrance; and
20.0–40.0 Weight percent water.

8 Claims, No Drawings

LIQUID TOILET BOWL CLEANER AND SANITIZER CONTAINING HALOGEN DONATING NANOPARTICLES

FIELD OF THE INVENTION

The present invention relates to concentrated liquid toilet bowl cleaning compositions.

BACKGROUND OF THE INVENTION

Compositions that automatically dispense cleaning agents and adjuvants into toilet bowls have been commercially available for many years. Numerous attempts have been made to add antimicrobial agents to these compositions. However, delivery of efficacious amounts of antimicrobial and other cleaning agents has been difficult.

It would be desirable to provide a liquid toilet bowl cleaning composition that efficiently delivers an efficacious amount of active ingredient to the bowl.

SUMMARY OF THE INVENTION

The present invention is directed to a concentrated liquid toilet bowl cleaning composition comprising an aqueous dispersion of particles of at least one halogen donating compound wherein said particles have a surface modifier adsorbed on the surface thereof in an amount sufficient to achieve a particle size of less than about 400 nanometers (nm). The compositions of the present invention can also contain other conventional ingredients in toilet bowl cleaning compositions such as surfactants, dyes, caustic, antisoiling agents, fragrances and other similar ingredients.

DETAILED DESCRIPTION OF THE INVENTION

The compositions of the present invention comprise halogen donating compounds containing nanoparticles.

A stable suspension of a halogen donating compound in nanoparticle form can deliver a consistent controlled dosage of active ingredients over the life of the product. Conventional suspensions would separate over time and reduce the product efficacy.

In the compositions of the present invention oxidizing species released by the halogen donating compound would not be available to destructively interact with other formulation ingredients. This would allow the incorporation of ingredients which normally are not compatible in liquid halogen bleach systems. For example, incorporation of a dye would be a valuable activity signal for the consumer.

Halogen donating compounds containing nanoparticles delivered to the toilet tank would dissolve more rapidly due to their small size and release sufficient quantities of halogen to sanitize the toilet bowl, with each flush, over approximately a thirty day period. Delivery of efficacious amounts of active to achieve sanitization has typically been an insurmountable hurdle for automatic toilet bowl cleaners due to the large volume of water than must be treated over time.

The quantity of available active halogen donating compound should fall within the range of 35 to 70 weight percent in the toilet bowl cleaner for effective efficacy.

Useful halogen donating compounds include halohydantoins such as 1,3-dichloro-5 5-dimethylhydantoin, 1,3-dichloro-5-ethyl-5-methylhydantoin and 1-bromo-3-3-chloro-5-5-dimethylhydantoin, calcium hypochlorite and similar compounds. Commercially available compositions containing these hydantoins include Dantochlor® RW and 8273 Dantoin® 8-2-5 available from LONZA, Inc., Fair Lawn, N.J.

The particles of this invention contain a discrete phase of a halogen donating compound as described above having a surface modifier adsorbed on the surface thereof. Useful surface modifiers are believed to include those which physically adhere to the surface of the halogen donating compound but do not chemically bond to the halogen donating compound.

Suitable surface modifiers can preferably be selected from known organic and inorganic excipients. Such excipients include various polymers, low molecular weight oligomers, natural products and surfactants. Preferred surface modifiers include nonionic and anionic surfactants. Representative examples of excipients include gelatin, casein, lecithin (phosphatides), gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, e.g., macrogol ethers such as cetomacrogol 1000, polyoxyethylene castor oil derivatives, polyoxyethylene sorbitan fatty acid esters, e.g., the commercially available Tweens, polyethylene glycols, polyoxyethylene stearates, colloidol silicon dioxide, phosphates, sodium dodecylsulfate, carboxymethylcellulose calcium, carboxymethylcellulose sodium, methylcellulose hydroxyethylcellulose, hydroxypropylcellulose, hydroxypropylmethycellulose phthalate, noncrystalline cellulose, magnesium aluminum silicate, triethanolamine, polyvinyl alcohol, and polyvinylpyrrolidone (PVP). Most of these excipients are described in detail in the Handbook of Pharmaceutical Excipients, published jointly by the American Pharmaceutical Association and The Pharmaceutical Society of Great Britain, the Pharmaceutical Press, 1986, the disclosure of which is hereby incorporated by reference in its entirety. The surface modifiers are commercially available and/or can be prepared by techniques known in the art.

The surface modifier is adsorbed on the surface of the halogen donating compound in an amount sufficient to maintain an effective average particle size of less than about 400 nm. The surface modifier does not chemically react with the halogen donating compound or itself. Furthermore, the individually adsorbed molecules of the surface modifier are essentially free of intermolecular crosslinkages.

As used herein, particle size refers to a number average particle size as measured by conventional particle size measuring techniques well known to those skilled in the art, such as sedimentation field flow fractionation, photon correlation spectroscopy, or disk centrifugation. By "an effective average particle size of less than about 400 nm" it is meant that at least 90% of the particles have a weight average particle size of less than about 400 nm when measured by the above-noted techniques. In preferred embodiments of the invention, the effective average particle size is less than about 250 nm. In some embodiments of the invention, an effective average particle size of less than about 100 nm has been achieved. With reference to the effective average particle size, it is preferred that at least 95% and, more preferably, at least 99% of the particles have a particle size less than the effective average, e.g., 400 nm. In particularly preferred embodiments, essentially all of the particles have a size less than 400 nm. In some embodiments, essentially all of the particles have a size less than 250 nm.

The particles of this invention can be prepared in a method comprising the steps of dispersing a halogen donating compound in a liquid dispersion medium and applying mechanical means in the presence of grinding media to reduce the particle size of the halogen donating compound to an effective average particle size of less than about 400 nm. The particles can be reduced in size in the presence of a surface modifier. Alternatively, the particles can be contacted with a surface modifier after attrition.

These methods are described in detail in U.S. Pat. No. 5,145,684.

The relative amount of halogen donating compound and surface modifier can vary widely and the optimal amount of the surface modifier can depend, for example, upon the particular halogen donating compound and surface modifier selected, the critical micelle concentration of the surface modifier if it forms micelles, etc. The surface modifier preferably is present in an amount of about 0.1-10 mg per square meter surface area of the halogen donating compound. The surface modifier can be present in an amount of 0.1-99.995%, preferably 20-60% by weight based on the total weight of the formulation.

The nanoparticles of the present invention can be incorporated into conventional liquid toilet bowl cleaning compositions, as for example those disclosed in U.S. Pat. Nos. 3,897,357 and 3,970,596, the disclosure of which is incorporated herein. These compositions contain a wide variety of conventionally available anionic, nonionic, cationic and amphoteric surfactants, sulfonate salts, neutralizers, disinfectants, thickeners, antisoiling agents, fluorescent whitening agents, chelating agents and fragrances.

Representative surfactants include alkanolamides, alkylaryl sulfonates, amine oxides, betaines, block copolymers, ethoxylated alcohols, as for example Neodol 23-6.5 available from Shell Chemical Company, alkylphenol ethoxylates, ethoxylated fatty acids, fluorosurfactants, as for example Zonyl FSD available from Dupont, imidazolines and derivatives, quaternary amines, linear alkyl sulfonates, sulfosuccinates and alkyl polyglycosides. Representative disinfectants include alkyl dimethyl benzyl ammonium chloride and orthophenylphenol. Representative thickeners include fumed silica, methyl cellulose derivatives, clays, polyacrylic acid, xanthan gum as for example Kelzan S available from Kelco Division of Merck & Co., Inc., polysaccharides and magnesium aluminum silicate. A representative chelating agent is tetrasodium edta.

The compositions of the present invention can be illustrated by the following representative example.

| | Preferred Wt. % | Range Wt. % |
|---|---|---|
| Example 1 | | |
| Water | 31.7 | 20.0–40 0 |
| Surfactant | 5.0 | 0.2–10.0 |
| Halohydantoin Nanoparticles | 60.0 | 35.0–75.0 |
| Acid Blue #9 | 3.0 | 1.0–7.0 |
| Sodium Hydroxide | 0.2 | 0–3.0 |
| Fragrance | 0.1 | 0.05–0.5 |

-continued

| | Preferred Wt. % | Range Wt. % |
|---|---|---|
| Example 2 | | |
| Water | Q.S. to 100% | 20.0–40.0 |
| Zonyl FSD | 0.2 | 0.2–10.0 |
| Neodol 23-6.5 | 5.0 | 0.2–10.0 |
| Halohydantoin Nanoparticles | 60.0 | 35.0–75.0 |
| Acid Blue #9 | 3.0 | 1.0–7.0 |
| Tetrasodium EDTA | 3.0 | 0–6.0 |
| Fragrance | 0.1 | 0.05–0.5 |
| Example 3 | | |
| Water | Q.S. to 100% | 20.0–40.0 |
| BTC 2125M | 0.2 | 0.2–10.0 |
| Neodol 23-6.5 | 5.0 | 0.2–10.0 |
| Halohydantoin Nanoparticles | 60.0 | 35.0–75.0 |
| Acid Blue #9 | 3.0 | 1.0–7.0 |
| Kelzan S | 0.4 | 0–3.0 |
| Fragrance | 0.1 | 0–0.5 |

The foregoing specification, including the specific embodiments and examples is intended to be illustrative of the present invention and is not to be taken as limiting. Numerous other variations and modifications can be effected without departing from the true spirit and scope of the present invention.

We claim:

1. A liquid toilet bowl cleaning and sanitizing composition comprising an aqueous dispersion of particles of at least one halogen donating compound wherein said particles have at least about 0.1 mg. per square meter surface area of the halogen donating compound of a surface modifier absorbed on the surface thereof in an amount sufficient to achieve a particle size of less than about 400 nanometers (nm), a surfactant, a dye and a fragrance wherein said particles are present in an amount of from 35 to 75 weight percent of the composition and the water is present in an amount of from 20 to 40 weight percent of the composition and said surface modifier physically adheres to the surface of the halogen donating compound but does not chemically bond to the halogen donating compound.

2. A composition as in claim 1 wherein the halogen donating compound is a halohydantoin.

3. A liquid toilet bowl cleaning and sanitizing composition as in claim 1 that comprises:

| Ingredient | Weight Percent |
|---|---|
| surfactant | 0.2–10.0 |
| halogen donating nanoparticles of claim 1 | 35.0–75.0 |
| dye | 1.0–7.0 |
| alkali | 0–3.0 |
| fragrance | 0.05–0.5 |
| water | 20.0–40.0 |

4. A composition as in claim 3 that further comprises a thickener.

5. A composition as in claim 3 that further comprises a chelating agent.

6. A composition as in claim 1 wherein the particles have an effective average particle size of less than about 250 nanometers.

7. A composition as in claim 1 wherein the particles have an effective average particle size of less than about 100 nanometers.

8. A method for cleaning and sanitizing toilet bowls comprising dispensing into the water of a toilet an effective amount of a composition of claim 1.

* * * * *